United States Patent [19]

Saiki et al.

[11] 4,180,035

[45] Dec. 25, 1979

[54] INTERNAL COMBUSTION ENGINE WITH AN EXHAUST GAS RECIRCULATION SYSTEM

[75] Inventors: Junichi Saiki, Susono; Teruo Kumai, Toyota, both of Japan

[73] Assignee: Toyota Jidosha Kogyo Kabushiki Kaisha, Aichi, Japan

[21] Appl. No.: 918,380

[22] Filed: Jun. 23, 1978

[30] Foreign Application Priority Data

Apr. 25, 1978 [JP] Japan ..... 53-48324

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 4,041,917 | 8/1977 | Suzuki | 123/119 A |
| 4,056,084 | 11/1977 | Baumgartner | 123/119 A |
| 4,069,797 | 1/1978 | Nohira et al. | 123/119 A |
| 4,090,482 | 5/1978 | Yoshida | 123/119 A |
| 4,092,960 | 6/1978 | Nohira et al. | 123/119 A |
| 4,124,004 | 11/1978 | Aoyama | 123/119 A |
| 4,128,090 | 12/1978 | Aoyama | 123/119 A |
| 4,130,093 | 12/1978 | Aoyama | 123/119 A |

*Primary Examiner*—Wendell E. Burns
*Attorney, Agent, or Firm*—Stevens, Davis, Miller & Mosher

[57] ABSTRACT

Disclosed is an internal combustion engine with an exhaust gas recirculation system. The engine is provided with an exhaust gas recirculation control valve device, a modulator valve device and a vacuum control valve device. The exhaust gas recirculation control valve device communicates an exhaust passage of the engine with an intake passage of the engine and is provided with a diaphragm chamber, partitioned by a diaphragm and communicating with a first port of a carburetor and a constant pressure chamber, partitioned by a valve body which is actuated by the diaphragm. The modulator valve device is provided with an upper diaphragm chamber, which is communicated with a second port disposed at a position nearer to a venturi portion of the carburetor than the first port and communicated with the vacuum control valve device. An orifice is disposed between a first communicating pipe, which communicates the first port with the diaphragm chamber of the exhaust gas recirculation control valve device, and another communicating pipe, which is communicated with a port disposed upstream of the first port.

5 Claims, 3 Drawing Figures

INTERNAL COMBUSTION ENGINE WITH AN EXHAUST GAS RECIRCULATION SYSTEM

BACKGROUND OF THE INVENTION

This invention relates to an internal combustion engine with an exhaust gas recirculation system.

Well known are exhaust gas recirculation engines which recirculate a part of the exhaust gas extracted from an exhaust system of the engine into an intake system of the engine for reducing harmful contaminants, especially nitrogen oxides ($NO_x$) contained in the exhaust gas.

One of the well known engines which has been developed is an internal combustion engine with an exhaust gas recirculation system comprising valve device for controlling the exhaust gas recirculation. The exhaust gas recirculation control valve device communicates an exhaust passage of the engine with an intake passage of the engine and is provided with a diaphragm chamber, partitioned by a diaphragm, and a constant pressure chamber, partitioned by a valve body which is actuated by the diaphragm. The engine further comprises a modulator valve device for modulating a vacuum signal which is transmitted from a first port disposed at a position upstream of a throttle valve of a carburetor to the diaphragm chamber. The modulator valve device is provided with an upper diaphragm chamber, which is communicated with a second port disposed at a position nearer to a venturi portion of the carburetor than the first port and communicated with a vacuum control valve device for controlling the vacuum pressure in accordance with changes in intake vacuum pressure, and a lower diaphragm chamber communicating with the constant pressure chamber of the exhaust gas recirculation control valve device.

In the above-described internal combustion engine with an exhaust gas recirculation system, while the engine load is low, since the intake vacuum of the engine becomes high, the vacuum control valve is actuated and the exhaust gas recirculation control valve device is closed. Therefore, the exhaust gas is not recirculated. When the load of the engine reaches a predetermined level, the intake vacuum becomes low. On the other hand, the constant pressure chamber of the exhaust gas recirculation control valve device is controlled so as to maintain a predetermined pressure which is almost equal to the atmospheric pressure. As a result, a part of the exhaust gas, the amount of which is proportional to that of the intake gas mixture, is recirculated into the engine. When the load of the engine is maximum, the pressure at the second port becomes vacuum pressure, and then, the pressure in the upper diaphragm chamber of the modulator valve device becomes vacuum pressure. In other words, since the pressure in the upper diaphragm chamber, becomes vacuum pressure, the exhaust gas recirculation control valve device is closed because the vacuum pressure in the constant pressure chamber is controlled so that it equals the pressure in the upper diaphragm chamber. As a result of the vacuum in the constant pressure chamber, the recirculation of the exhaust gas from the exhaust passage to the intake passage is stopped. As mentioned above, a desired amount of exhaust gas is recirculated in accordance with changes in the engine loads.

The above-mentioned internal combustion engine with an exhaust gas recirculation system may cause a defect that, when a vehicle in which the engine is installed is started or accelerated, the torque of the engine will be decreased and the speed of the vehicle will be temporarily lowered. This phenomenon is called "breathing phenomenon". When the breathing phenomenon continues for a certain period of time, a phenomenon which is called "surging phenomenon" is caused and the driveability of the vehicle is reduced. When such breathing and surging phenomena are caused, the driver may step on the accelerator gas pedal excessively, which can result in a defect that the amount of carbon monoxide (CO) emitted from the engine is increased.

SUMMARY OF THE INVENTION

An object of the present invention is to provide an internal combustion engine with an exhaust gas recirculation system which can obviate the abovementioned breathing and surging phenomena.

Another object of the present invention is to provide an internal combustion engine with an exhaust gas recirculation system which can decrease the amount of the recirculated exhaust gas at a low speed of the engine, and accordingly, the degradation of the driveability can be prevented, so that the accelerator gas pedal is not stepped on excessively during the accelerating operation of the vehicle, and as a result, an increase in the CO emission can be prevented from occurring.

A further object of the present invention is to provide an internal combustion engine with an exhaust gas recirculation system which can recirculate a large amount of the exhaust gas while the engine is rotating at intermediate and high speeds, and therefore, the $NO_x$ reducing effect of the recirculated exhaust gas can be achieved.

Some embodiments of the present invention will now be explained with reference to the accompanying drawings.

DETAILED DESCRIPTION OF THE INVENTION

Figure 1:
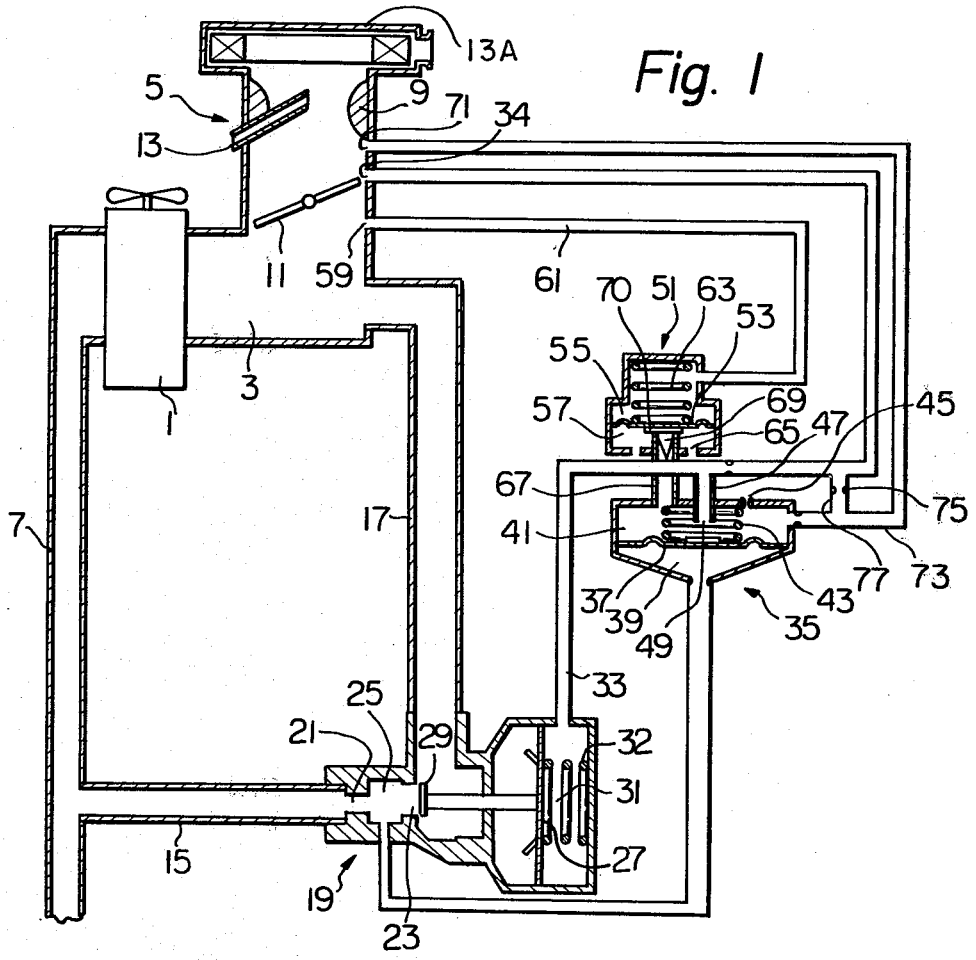
FIG. 1 is a piping diagram of a first embodiment of the present invention.

Referring to FIG. 1, which illustrates the first embodiment of the present invention, an engine 1 is supplied with combustible gas mixture from a carburetor 5 via an intake manifold 3. The engine discharges the exhaust gas into a muffler (not shown) via an exhaust manifold 7 and a catalytic converter (not shown). The carburetor 5 comprises a venturi portion 9, which is provided with a fuel jet 13, and a throttle valve 11, which is disposed at a space downstream of the venturi portion 9 and which is swingable in synchronization with an accelerator pedal (not shown) so that the amount of the intake gas mixture is controlled. The carburetor 5 admixes air taken in from an air filter 13A with fuel supplied from the fuel jet 13 opened at the venturi portion 9, and then, combustible gas mixture is obtained.

The exhaust manifold 7 and the intake manifold 3 are communicated with each other via exhaust gas circulating pipes 15 and 17 and an exhaust gas recirculation control valve device 19. The exhaust gas recirculation control valve device 19 comprises a constant pressure chamber 25 which is partitioned by a measuring orifice 21 and a valve seat 23, a valve body 29 which cooperates with the valve seat 23 and controls the flow of the recirculated exhaust gas, and a diaphragm chamber 31 partitioned by a diaphragm 27 which is connected to the valve body 29.

The diaphragm chamber 31 has a compression spring 32 mounted therein for urging the diaphragm 27 and is communicated with a first port 34, which is disposed just upstream of the throttle valve 11 of the carburetor 5, via a first communicating pipe 33, and the diaphragm 27 is actuated by the vacuum supplied to the diaphragm chamber 31 from the first port 34. A pipe 47 branched from the first communicating pipe 33 is communicated with a modulator valve device 35, so that the pressure in the constant pressure chamber 25 of the exhaust gas recirculation valve device 19 is maintained at the atmospheric pressure. More specifically, the constant pressure chamber 25 is communicated with a lower diaphragm chamber 39 of the modulator valve device 35, which chamber is partitioned by a diaphragm 37. An upper diaphragm chamber 41, which is partitioned by the diaphragm 37, has a compression spring 43 for urging the diaphragm 37 mounted therein and an opening 45 formed on the wall thereof for communicating the upper diaphragm chamber 41 with the outside thereof. A valve seat 49, formed at the bottom end of the branched pipe 47 which is communicated with the first communicating pipe 33, cooperates with the diaphragm 37. Accordingly, when the pressure in the constant pressure chamber 25 exceeds the atmospheric pressure, the valve seat 49 is closed by the diaphragm 37, and then, the diaghragm chamber 31 is supplied with the vacuum from the first port 34. As a result, the valve body 29 is separated from the valve seat 23, and then, the pressure in the constant pressure chamber 25 is lowered to a pressure equal to the atmosheric pressure which is supplied to the modulator valve device 35 through the opening 45. When the exhaust gas recirculation control valve device 19 is controlled in the above-mentioned manner, it is well known that the amount of the recirculated exhaust gas is proportional to that of the intake gas mixture through the intake manifold 3.

Since the upper diaphragm chamber 41 of the modulator valve device 35 is communicated with a vacuum control valve device 51, which is actuated by intake vacuum supplied from downstream of the throttle valve 11, the vacuum contained in the upper diaphragm chamber 41 is discharged into the atmosphere through an opening 65 of the vacuum control valve device 51 while the engine load is low, and then, the exhaust gas recirculation control valve device 19 is closed. The vacuum control valve device 51 is provided with an upper diaphragm chamber 55 and a lower diaphragm chamber 57, which chambers are partitioned by a diaphragm 53. The upper diaphragm chamber 55 is communicated with an intake port 59 for supplying intake vacuum, which port is located downstream of the throttle valve 11 of the carburetor 5.

The upper diaphragm chamber 55 has a commpression spring 63 for urging the diaphragm 53 mounted therein. The lower diaphragm chamber 57 has the opening 65 formed on the wall thereof and is communicated with the upper diaphragm chamber 41 of the modulator valve device 35 via a short pipe 67. The diaphragm 53 has a needle valve 69 fixed thereon. Accordingly, as the diaphragm 53 is displaced, the needle valve 69 cooperates with a valve seat 70 formed at the top end of the short pipe 67, and then, the vacuum contained in the upper diaphragm chamber 41 is discharged into the atmosphere through the opening 65 of the vacuum control valve device 51. As a result, when the engine load is low, in other words, the intake vacuum is high vacuum, the vacuum contained in the upper diaphragm chamber 41 of the modulator valve device 35 is discharged and the vacuum pressure is decreased, and then, the exhaust gas recirculation control valve device 19 is closed.

A second port 71 is disposed at a position between the first port 34, which is located upstream of the throttle valve 11 of the carburetor 5 while the throttle valve 11 is not wide opened, and the venturi portion 9, but the second port 71 is located downstream of the throttle valve 11 when the throttle valve 11 is wide open. The second port 71 is communicated with the upper diaphragm chamber 41 of the modulator valve device 35 via a communicating pipe 73. Accordingly, when the throttle valve 11 is wide open and the pressure at the second port 34 becomes vacuum pressure, the upper diaphragm chamber 41 is filled with the vacuum supplied from the second port 34. Then, the exhaust gas recirculation control valve device 19 is closed so that the pressure in the constant pressure chamber thereof is brought to vacuum pressure and the recirculation of the exhaust gas is stopped.

Figure 2:
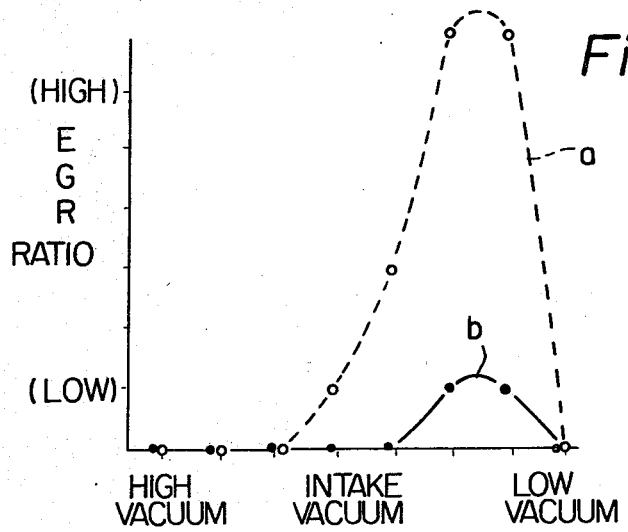
FIG. 2 is a operating characteristics diagram of an engine according to the present invention, which diagram illustrates the relationship between intake vacuum and EGR ratio.

If the above-mentioned engine characteristics are plotted on a graph, a diagram which is similar to that illustrated by broken line "a" in FIG. 2 can be obtained. In FIG. 2, the intake vacuum of the engine is plotted on the abscissa and EGR ratio, which is defined as the percentage of the weight of the recirculated exhaust gas to the weight of the intake air, is plotted on the ordinate.

Figure 3:
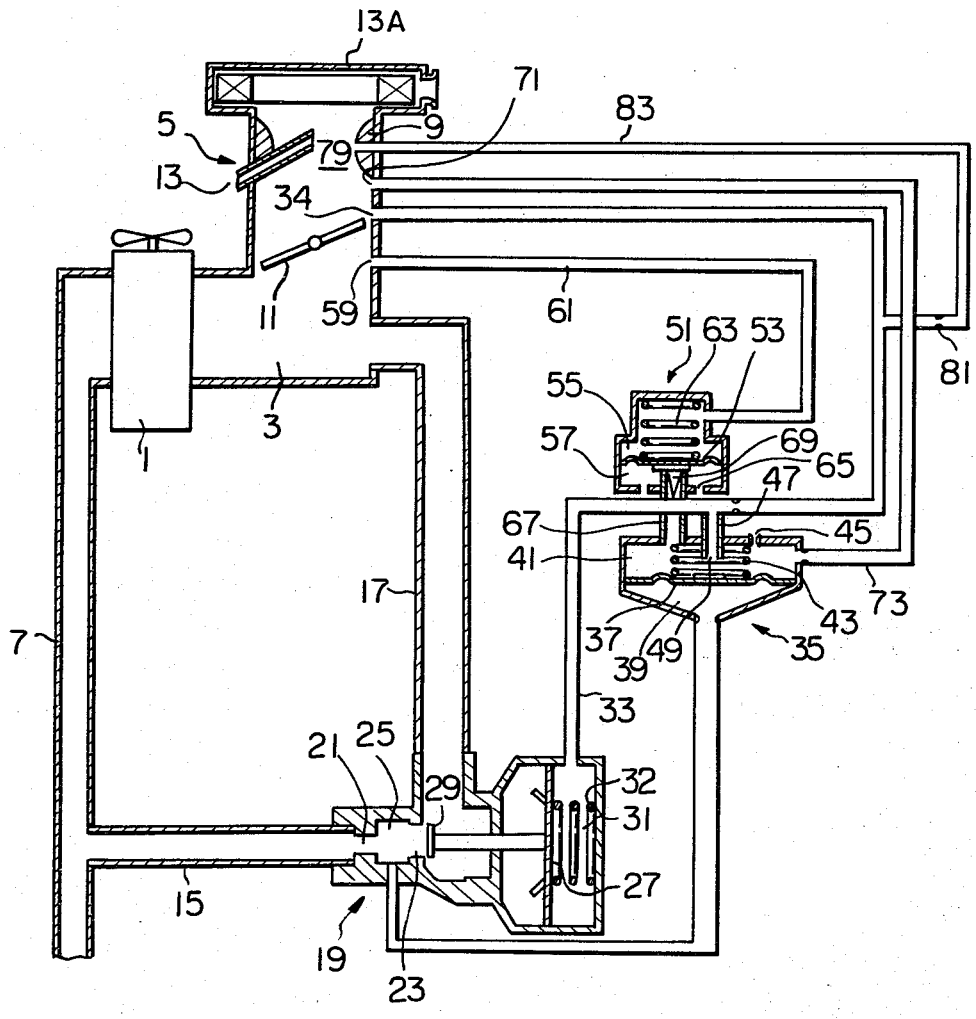
FIG. 3 is a piping diagram of a second embodiment of the present invention.

The internal combustion engine of the above-mentioned construction, however, may cause the breathing and surging phenomena when the vehicle in which the enging is installed is started or accelerated from a low speed. To obviate the phenomena, in the first embodiment of the present invention, which is illustrated in FIG. 1, the first communicating pipe 33, which communicates the diaphragm chamber 31 of the exhaust gas recirculation control valve device 19 with the first port 34, is communicated with the second communicating pipe 73, which communicates the upper diaphragm chamber 41 of the modulator valve device 35 with the second port 71, via a short pipe 77, which has an orifice 75 formed therein. In a second embodiment of the present invention, which is illustrated in FIG. 3, the first communicating pipe 33 is communicated with a venturi port 79, which is disposed at the venturi portion 9 of the carburetor 5, via a third communicating pipe 83, which has an orifice 81 formed therein.

In the first embodiment illustrated in FIG. 1, when the engine speed is low, the vacuum pressure at the first port 34 is higher than that at the second port 71. Therefore, the vacuum supplied from the first port 34 through the first communicating pipe 33 passes through the orifice 75 of the short pipe 77. Then, the vacuum is discharged from the second port 71, the opening 45 of the modulator valve device 35 and the opening 65 of the vacuum control valve device 51. As a result, the vacuum pressure in the diaphragm chamber 31 of the exhaust gas recirculation control valve device 19 is decreased and the opening of the exhaust gas recirculation control valve device 19 becomes small. Then, the amount of the recirculated exhasut gas is decreased and the EGR ratio characteristics illustrated by solid line "b" in FIG. 2 can be obtained. In the second embodiment illustrated in FIG. 3, the vacuum supplied from the first port 34 is discharged from the venturi port 79, instead of the second port 71 in the first embodiment illustrated in FIG. 1, and the EGR ratio is decreased.

When the engine speed is high, the edge of the throttle valve 11 is located at a position upstream of the second port 71. As a result the first port 34 and the second port 71 are supplied with respective vacuums, the pressure difference of which is very small. Accordingly, referring to FIG. 1, since the amount of the vacuum which is supplied from the first port 34 and discharged from the second port 71, via the orifice 75, is very small, the engine has the characteristics illustrated by broken line "a" in FIG. 2. These characteristics are similar those obtained with an engine in which the first communicating pipe 33 is not communicated with the second communicating pipe 73 via the short pipe 77. Referring to FIG. 3, since the vacuum pressure at the venturi port 79 is higher than that at the first port 34, the exhaust gas recirculation control valve device 19 is influenced very little by the discharge of the vacuum through the orifice 81, and operating characteristics of the engine which are similar to those illustrated by broken line "a" in FIG. 2 can be obtained.

What we claim is:

1. An internal combustion engine with exhaust gas recirculation system comprising:

a valve device for controlling the exhaust gas recirculation which communicates an exhaust passage of said engine with an intake passage of said engine and which is provided with a diaphragm chamber, partitioned by a diaphragm, and a constant pressure chamber, partitioned by a valve body which is actuated by said diaphragm;

a modulator valve device for modulating a vacuum signal which is transmitted from a first port disposed at a position upstream of a throttle valve of a carburetor to said diaphragm chamber, said modulator valve device is provided with an upper diaphragm chamber, which is communicated with a second port disposed at a position nearer to a venturi portion of said carburetor than said first port, and a lower diaphragm chamber, which is communicated with said constant pressure chamber of said exhaust gas recirculation control valve device;

a vacuum control valve device for controlling the vacuum pressure in said upper diaphragm chamber of said modulator valve device in accordance with changes in intake vacuum of said engine, said vacuum control valve device is provided with an upper chamber, which is partitioned by a diaphragm and communicated with said intake passage of said engine, and a lower chamber, which is communicated with said upper diaphragm chamber of said modulator valve device and which has an opening for discharging vacuum therefrom formed on the wall thereof, and;

an orifice which communicates a first communicating pipe, which communicates said first port with said diaphragm chamber of said exhaust gas recirculation valve device, with another communicating pipe, which is communicated with a port disposed upstream of said first port.

2. An internal combustion engine according to claim 1, wherein said modulator valve device further comprises an opening formed on the wall of said upper diaphragm chamber thereof.

3. An internal combustion engine according to claim 1, wherein said vacuum control valve device further comprises a needle valve fixed on said diaphragm thereof, which valve controls the flow of the vacuum from said upper diaphragm chamber of said modulator valve device to said lower chamber of said vacuum control valve device in accordance with displacement of said diaphragm of said vacuum control valve device due to change of said intake vacuum pressure.

4. An internal combustion engine according to claim 1, 2 or 3, wherein said other communicating pipe is a communicating pipe which communicates said second port with said upper diaphragm chamber.

5. An internal combustion engine according to claim 1, 2 or 3, wherein said other communicating pipe is a communicating pipe which is communicated with a venturi bleed port disposed at a position upstream of said second port.

* * * * *